US005347676A

United States Patent [19]

Saitoh

[11] Patent Number: 5,347,676

[45] Date of Patent: Sep. 20, 1994

[54] SQUEEGEE

[75] Inventor: Hiroshi Saitoh, Chiba, Japan

[73] Assignee: Kabushiki Kaisha Hoky, Chiba, Japan

[21] Appl. No.: 43,726

[22] Filed: Apr. 6, 1993

[30] Foreign Application Priority Data

Apr. 17, 1992 [JP] Japan ..... 4-124158

[51] Int. Cl.[5] ..... A47L 1/06

[52] U.S. Cl. ..... 15/245; 15/121

[58] Field of Search ..... 15/117, 121, 245, 245.1, 15/250.36, 250.41, 114

[56] References Cited

U.S. PATENT DOCUMENTS

| | | | |
|---|---|---|---|
| 2,347,963 | 5/1944 | O'Neil | 15/245 |
| 2,425,215 | 8/1947 | West | 15/245.1 |
| 3,126,652 | 3/1964 | Reissinger | 15/245 |
| 3,274,684 | 9/1966 | Marks | 15/236.05 |
| 3,766,591 | 10/1973 | Soito . | |
| 4,627,128 | 12/1986 | Shea | 15/245 |
| 4,716,616 | 1/1988 | Poon . | |
| 4,768,259 | 9/1988 | Bell | 15/236.01 |
| 4,787,113 | 11/1988 | Kamenske | 15/245 |
| 4,954,001 | 9/1990 | Billat | 15/121 |
| 5,101,530 | 4/1992 | Hansen | 15/245 |
| 5,184,372 | 2/1993 | Mache | 15/245 |

FOREIGN PATENT DOCUMENTS

| | | | |
|---|---|---|---|
| 854398 | 4/1940 | France | 15/250.36 |
| 1271136 | 7/1960 | France | 15/250.36 |
| 236731 | 3/1945 | Switzerland | 15/121 |
| 16416 | of 1901 | United Kingdom | 15/121 |

*Primary Examiner*—Timothy F. Simone
*Assistant Examiner*—Terrence R. Tin

[57] ABSTRACT

In order that liquid swept up by blades is introduced positively into a baseplate section to elevate a recovery percentage of liquid, the baseplate section is adapted to include an open section positioned on the upper end portion of the blades along them and which is opened forwardly in the operating direction of the squeegee, and a trough-like section for introducing liquid having a profile which is defined in such that its axial direction extends along the upper end portion of the blades and its wall surface protrudes backwardly in the operating direction, whereby liquid swept up by these blades is transferred from the lower end portion of the blades to the upper end portion thereof to be introduced into the section for introducing liquid.

14 Claims, 4 Drawing Sheets

FIG. 1
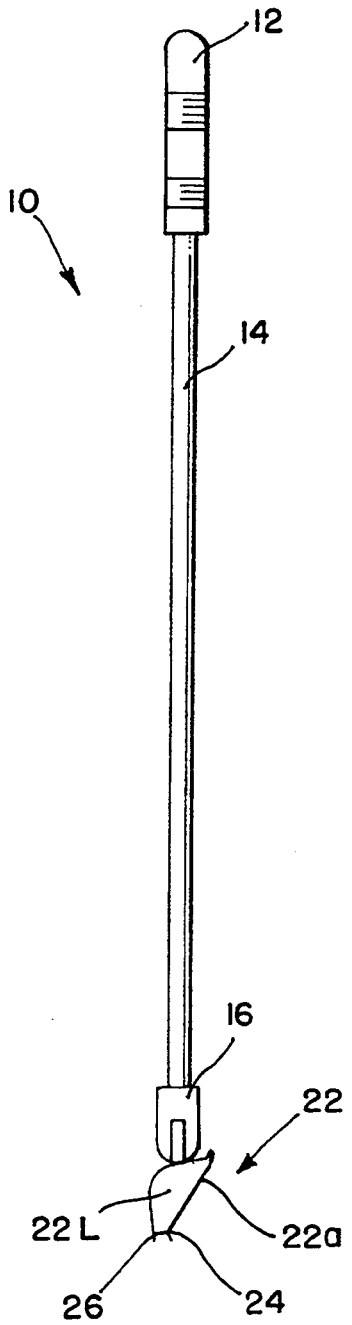
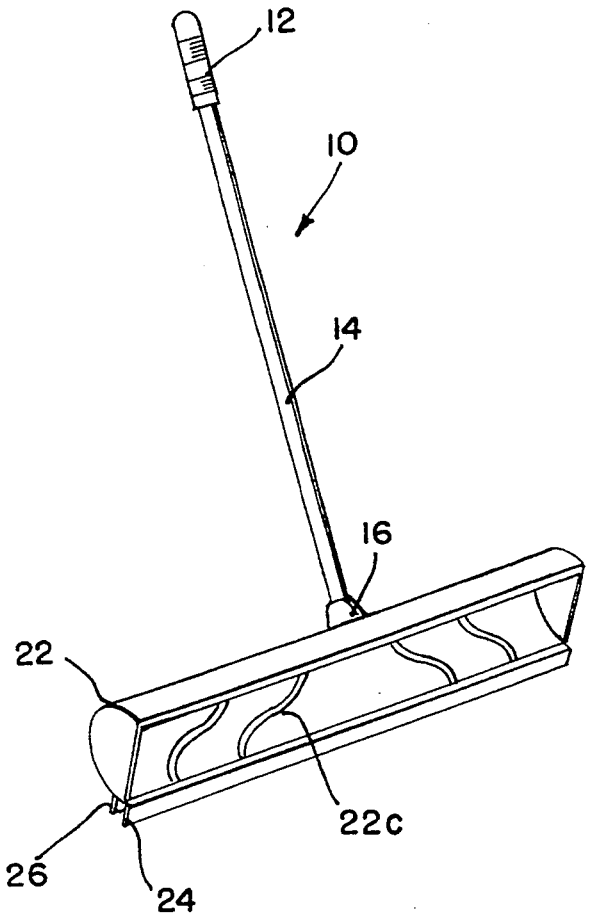
FIG. 3

SQUEEGEE

BACKGROUND OF THE INVENTION

1. Field of the Invention

The present invention relates to a squeegee, and more particularly to such a squeegee which is used for sweeping up or scratching off liquid or the like.

2. Description of the Related Art

In general, an instrument what is called a "squeegee" is used for sweeping up or scratching off water gathered on the surface of a floor and the like, a release agent in case of working for releasing wax, or rainwater and the like staying on the surface of a road and the like to gather the same, and then collecting the object thus swept up or scratched off in a predetermined place or container for the sake of disposal of such collected object.

A conventional squeegee having, for example, such a construction that a baseplate section which extends along a surface to be cleaned such as the surface of a floor or the like is attached to the lower lend of a rod-shaped handle, and a blade composed of rubber or the like material having flexibility is disposed on the baseplate section so as to protrude the extreme end portion of the blade from the lower end portion of the baseplate section is known.

The conventional squeegee as described above is operated to sweep up water or the like on the surface of a floor by utilizing flexibility of a blade, and then the water or the like thus swept up is gathered at a certain place or collected in a container.

In the above described conventional squeegee, liquid swept up by means of the blade transfers from the lower end portion of the blade to the upper end portion thereof, and then reaches the baseplate section. However, there is such a problem in that a recovery percentage of liquid is poor. This is because the liquid which reaches the baseplate section overflows from the upper end and opposite end portions of the baseplate section towards the upper, right and left directions.

OBJECT AND SUMMARY OF THE INVENTION

The present invention has been made in view of the problem as described above which was involved in the prior art. A principal object of the invention is to provide a squeegee in which liquid swept up by blades is introduced positively into a baseplate section thereby to elevating a recovery percentage of liquid.

In order to attain the above object, the squeegee according to the present invention is constructed such that it includes a baseplate section extending along a surface to be cleaned, and blades each of which is disposed on the lower end portion of the baseplate section and formed with a profile projecting outwardly from the baseplate section wherein the baseplate section has an open section positioned on the upper end portion of the blades along them and opened forwardly in the operating direction of the squeegee, and a trough-like curved section for introducing liquid which is defined in such that its axial direction extends along the upper end portion of the blades and its inner circumferential wall surface protrudes backwardly in the operating direction, whereby liquid swept up by means of said blades is transferred from the lower end portion of the blades to the upper end portion thereof, then introduced into the section for introducing liquid or liquid-introducing section.

Furthermore, the trough-like section for introducing liquid has side wall portions on the opposite ends thereof in a direction substantially perpendicular to that extending along the upper end portion of the blades, and the side wall portions protrudes forwardly in the operating direction.

Still further, the trough-like section for introducing liquid includes at least one relieved streak extending along the inner circumferential wall surface and inclined circumferentially with respect to a surface to be cleaned in such that an end of the relieved streak is positioned in the outward direction at the lower portion of the baseplate section, while the other end thereof is positioned in the central direction at the upper portion of the baseplate section.

Liquid swept up by the blades is transferred from the lower end portion of the blades to the upper end portion thereof, and then introduced and guided into the liquid-introducing section from the open section positioned in the upper end portion of the blades. The axial direction of the liquid-introducing section extends along the upper end portion of the blades which is formed in a trough-like shape. Accordingly, the squeegee of the present invention may be transferred for sweeping up liquid on a surface to be cleaned while holding a stream of liquid on the site where the inner circumferential wall surface is defined in a curved surface profile so that a recovery percentage of liquid swept up is elevated. In this case, since liquid flows along the curved surface profile in the inner circumferential wall surface of the liquid-introducing section, the liquid which reaches the upper end portion of the liquid-introducing section is returned forwardly in the open section, and there is not a case where the liquid goes over the upper end portion of the liquid-introducing section and then, escapes outside the baseplate section. Moreover, when side wall portions are disposed on the opposite ends of the liquid-introducing section, it becomes possible to positively prevent liquid from escaping through the opposite end portions of the liquid-introducing section.

Still further, when relieved streaks are defined on the inner circumferential wall surface of the liquid-introducing section, liquid flowed into the liquid-introducing section from the blades tends to transfer from the lower part to the upper part along the relieved streaks, so that such liquid swept up from the opposite end portions of the baseplate section comes to flow also into the central portion thereof, and thus escape of the liquid from the end portions of the baseplate section is more positively prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is an explanatory view, in the overall construction, showing an embodiment of the squeegee according to the present invention;

FIG. 3 is a schematic perspective view of the squeegee shown in FIG. 1.

DETAILED DESCRIPTION OF THE PREFERRED EMBODIMENTS

Figure 2:
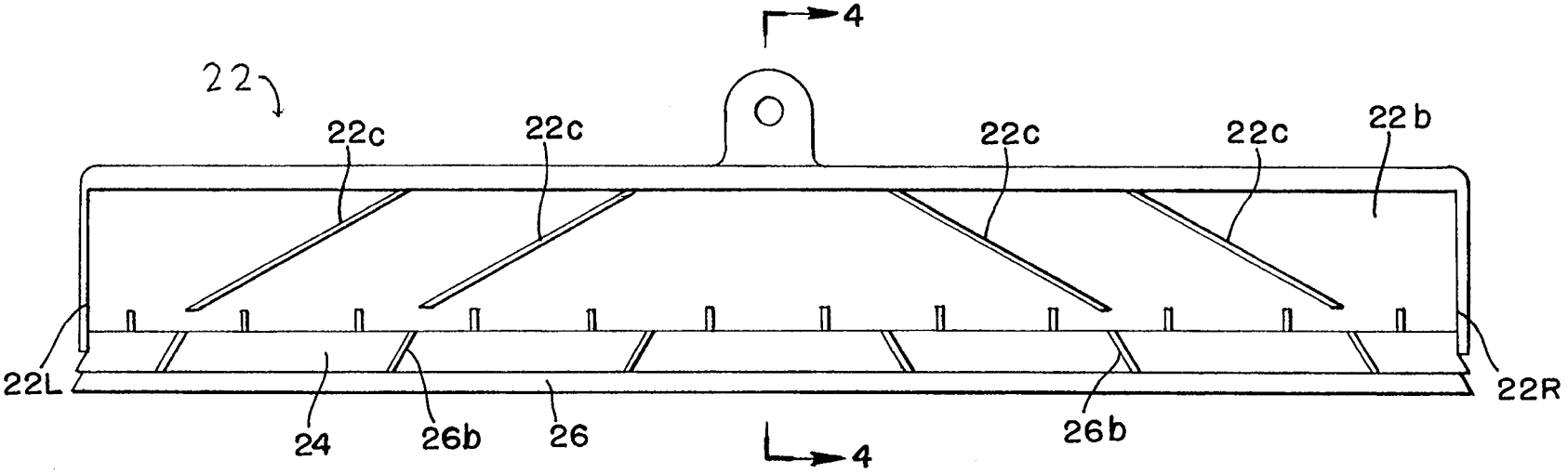
FIG. 2 is a front view showing a baseplate section of the squeegee according to the present invention.

An embodiment of the squeegee according to the present invention will be described in detail hereinbelow in conjunction with the accompanying drawings.

FIG. 1 shows the overall construction of a squeegee 10 which comprises a handle 14 to which is attached a grip functioning to prevent the handle from slipping at the upper end portion of the handle 14, a connector 16 affixed to the lower end portion of the handle 14, a baseplate section 22 secured to the connector 16 by means of a bolt 18 and a nut 20, and blades 24 and 26 each of which has suitable flexibility and is disposed on the lower end portion of the baseplate section 22 so as to protrude therefrom.

The baseplate section 22 is constituted in such that it extends along a surface to be cleaned in order that liquid spread on such surface of a floor, pavement or the like is swept up or scratched off by the use of the squeegee in the case when the baseplate section 22 of the squeegee 10 is positioned on the surface to be cleaned. The overall profile of the baseplate section 22 includes an open section **22*a* on the front side in operating direction and which forms a trough-like transverse piece extending axially along the surface to be cleaned, and the wall surface 22*b* of the baseplate 22 constitutes a liquid-introducing section in a curved surface. Furthermore, provided on the opposite ends of the baseplate 22 are side wall portions 22L and 22R which project towards the side of the open section 22*a***.

Moreover, a plurality of relieved streaks **22*c* are formed on the wall surface 22*b* on the side of the open section 22*a* of the baseplate section 22, respectively. A half of these relieved streaks 22*c* positioned on the side of the side wall portion 22L being bounded by the central portion in the axial direction of the baseplate section 22 is disposed in such an inclined manner with respect to a surface to be cleaned that the lower end of each of the relieved streaks 22*c* is arranged properly towards the side of the side wall portion 22L, while the upper end of each of the relieved streaks 22*c* is arranged properly towards the central portion in the axial direction of the baseplate section 22. The rest of these relieved streaks 22*c* positioned on the side of the side wall portion 22R and the former half relieved streaks are disposed just symmetrically with respect to the central bounding portion in the axial direction of the baseplate section 22. More specifically, all the relieved streaks 22*c* are arranged to show a Japanese Katakana character " ", i.e. the latter half relieved streaks 22*c* positioned on the side of the side wall portion 22R are disposed in such an inclined manner with respect to a surface to be cleaned that the lower end of each of the relieved streaks 22*c* is arranged properly towards the side of the side wall portion 22R, while the upper end of each of the relieved streaks 22*c* is arranged properly towards the central portion in the axial direction of the baseplate section 22**.

The blade 24 is parallel to the blade 28, and they are constructed in such that a length of the blade 26 positioned on the backward side in the operating direction is longer than that of the blade 24 positioned on the forward side in the operating direction so that such liquid which has remained after sweeping up liquid on the surface of a floor by means of the blade 24 can be captured by the blade 26.

Figure 5:
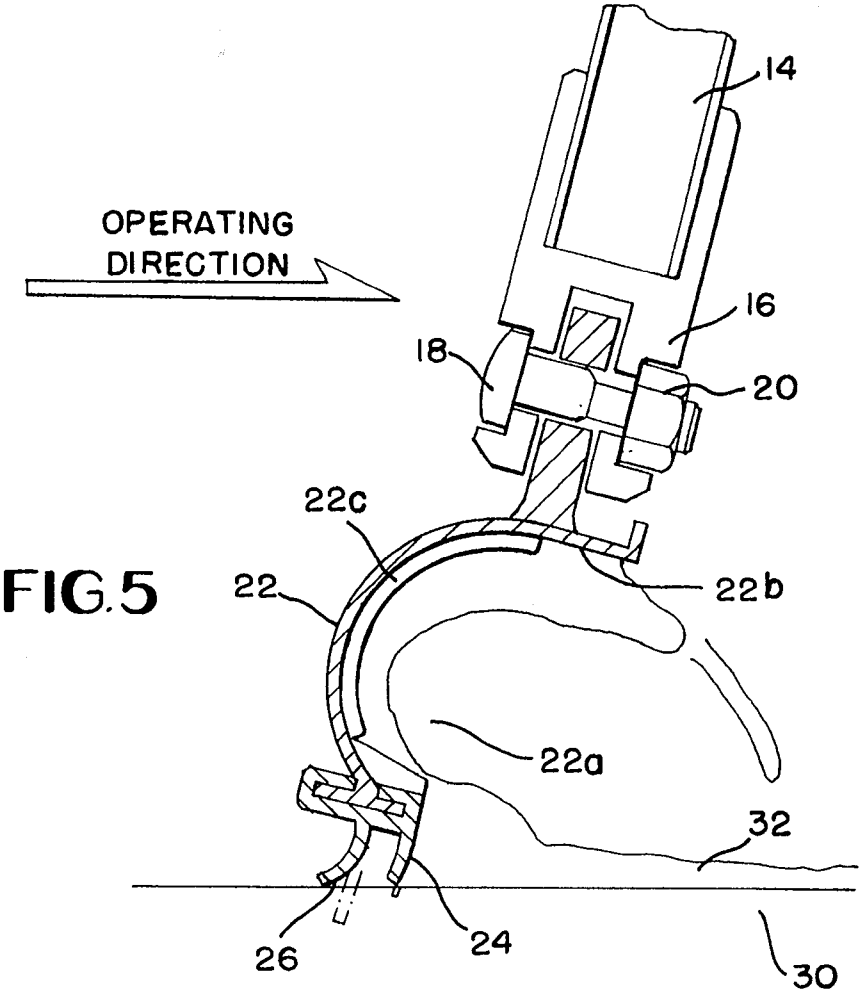
FIG. 5 is an explanatory view, in the section, showing a state of sweeping up liquid on the surface of a floor by the use of the squeegee according to the present invention.
Figure 4:
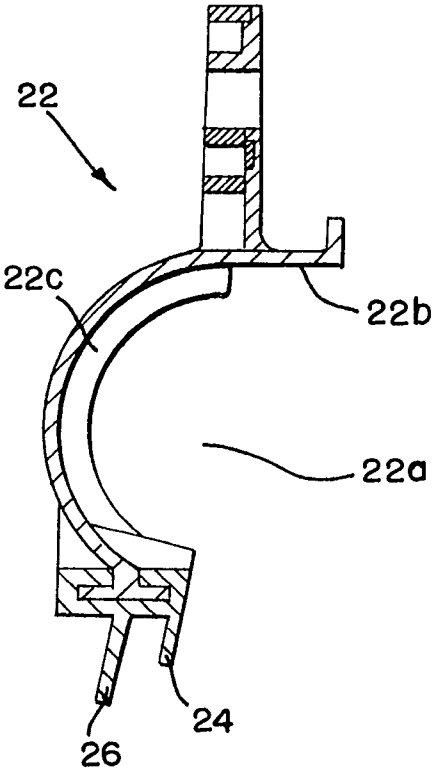
FIG. 4 is a sectional view showing a baseplate section and blades of the squeegee according to the present invention.
Figure 6:
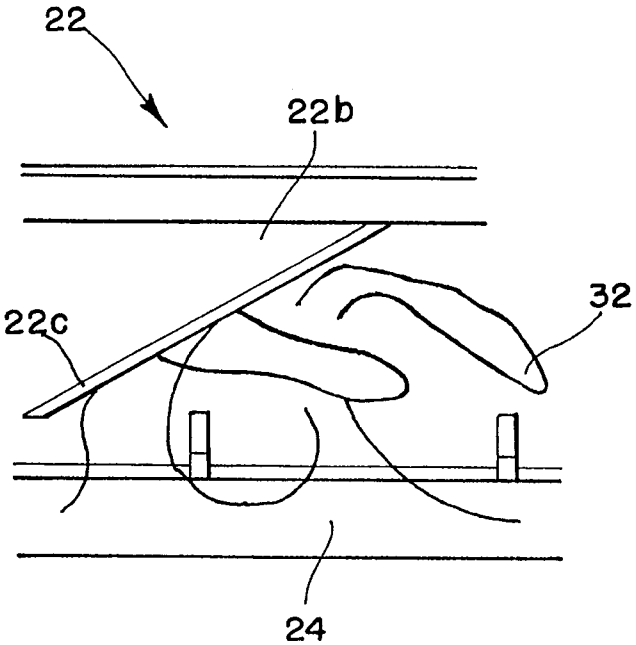
FIG. 6 is an explanatory view, in the essential front section of the squeegee according to the present invention. showing the state corresponding to that of FIG. 5.

In accordance with the construction as described above, the squeegee 10 is used to sweep up liquid on the surface of a floor in such that the squeegee 10 is operated so as to direct the open section **22*a* to the forward operating direction as shown in FIG. 5. Liquid 32 being present on the surface of a floor 30 to be cleaned is swept up by means of the blades 24 and 26 so that the liquid 30 flows from the lower end portions of the blades 24 and 26, in turn, to the upper portions thereof, then is introduced along an arcuate curved surface of the baseplate section 22, and flows into the wall surface portion 22*b*. The liquid 32 which flows into the wall surface portion 22*b* is reflected and introduced by the relieved streak 22*c* as shown in FIG. 6 to form a stream of water transferring to the central portion in the axial direction of the baseplate section 22. Because of such stream of water, an amount of liquid to be held in the baseplate section 22 increases so that liquid can be collected more efficiently by the construction of the squeegee 10** according to the present invention.

Thus, the liquid introduced in the wall surface portion **22*b* is held in the baseplate section 22, and as a result the liquid can be positively collected at a predetermined place with transfer of the squeegee 10**.

Furthermore, such liquid swept up at the opposite end portions of the baseplate section 22 is prevented from running away from the opposite end portions of the baseplate section 22 to the outside because of the existence of the side wall portions 22L and 22R. In addition, the liquid swept up from the opposite end portions of the baseplate section 22 is also transferred by the relieved streaks **22*c* as a stream of water towards the central portion of the baseplate section 22. Accordingly, escape of liquid from the opposite end portions of the baseplate section 22** is more positively prevented.

In case of sweeping up of liquid, when the wall surface **22*b* has been curved, waterdrops become spherical due to surface tension resulting in promotion of transferring liquid, and thus a stream of water towards the central portion of the baseplate section 22** can be efficiently formed.

Furthermore, since liquid transfers along the curved surface of the wall surface **22*b*, the liquid which reaches the upper end portion of the baseplate section 22 is returned to a forward position in the open section 22*a* so that the liquid does not escape outside the baseplate section 22 over the upper end portion of the baseplate section 22, and therefore liquid is prevented from dropping again to the surface of the floor 30 which has already been swept up by the use of the squeegee 10**.

Figure 7:
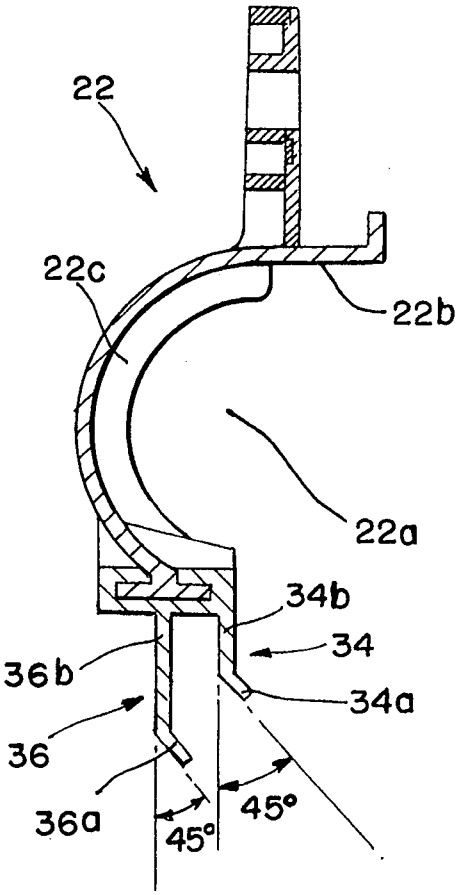
FIG. 7 is a sectional view corresponding to that of FIG. 4 showing a modification of the blade used in the squeegee according to the present invention.

FIG. 7 illustrates a modification of the blades in which a blade 34 is parallel to a blade 36, and they are constructed in such that a length of the blade 36 positioned backward in the operating direction is longer than that of the blade 34 positioned forward in the operating direction, and further extreme end portions 34*a* and 36*a* of the respective blades 34 and 36 are curved towards the side of the open section 22*a* with a predetermined angle with respect to extension lines of the blades 34 and 36 (the angle is set at 45° in the present modification).

Accordingly, impact resilient force of these blades with respect to the floor surface 30 is elevated resulting in an increase of compelling force of the extreme end portions 34*a* and 36*a* of the blades 34 and 36 against the floor surface 30 so that it becomes possible to elevate pressing force of the blades 34 and 36 against a surface to be cleaned. For this reason, it is possible to obtain more effective force for capturing liquid by means of the blades 34 and 36, and property for sweeping up or scratching off liquid on the surface of the floor 30 is improved.

The squeegee of the present invention has been constructed as described above, it has the following advantages.

More specifically, the squeegee according to the present invention has a baseplate section extending along a surface to be cleaned, and blades each of which is disposed on the lower end portion of the baseplate section and formed with a profile projecting outwardly from the baseplate section wherein the baseplate section includes an open section positioned on the upper end portion of the blades along them and which is opened forwardly in the operating direction of the squeegee, and a trough-like section for introducing liquid having a curved surface profile which is defined in such that its axial direction extends along the upper end portion of the blades and its inner circumferential wall surface protrudes backwardly in the operating direction. According to the construction of the above described squeegee, liquid swept up by means of these blades is transferred from the lower end portion of the blades to the upper end portion thereof, and then introduced from the open section positioned on the upper end portion of the blades into the section for introducing liquid, whereby the liquid is collected in the central portion thereof. Since the liquid-introducing section is defined in a trough-like profile having the axial direction extending along the upper end portion of the blades, the squeegee can be transferred while sweeping up liquid on a surface to be cleaned with maintenance of a stream of liquid on the site where the inner circumferential wall surface of the liquid-introducing section is curved. Thus, a recovery percentage of sweeping up of liquid can be elevated by the use of the squeegee of the present invention.

Furthermore, according to such construction that side cover portions are disposed on the opposite ends of the trough-like liquid-introducing section in a direction substantially perpendicular to that extending along the upper end portion of the blades, and in addition they protrude forwardly in the operating direction, it becomes possible to positively prevent liquid from escaping from the opposite end portions.

Moreover, according to such construction that at least one relieved streak extends along the circumferential direction of the trough-like liquid-introducing section in an inclined manner with respect to a surface to be cleaned in such that an end of the relieved streak is positioned in the outward direction at the lower portion of the baseplate section, while the other end thereof is positioned in the central direction at the upper portion of the baseplate section along the inner circumferential wall surface of the liquid-introducing section, liquid which flows into the liquid-introducing section from the blades transfers from the lower portion to the upper portion along the relieved streak, and as a result liquid swept up from the opposite end portions of the baseplate section tends to also flow into the central portion, so that it is possible to more positively prevent liquid from escaping from the opposite end portions of the baseplate section.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A squeegee comprising a baseplate section extending along a surface to be cleaned and a plurality of blades, each of the blades being disposed on a lower end portion of said baseplate section and being formed with a profile projecting outwardly from said baseplate section, each of the blades having an extreme end portion, the extreme end portion of the blades abuts on said surface to be cleaned, said baseplate section having an open section positioned on an upper end portion of said blades, the open section extending along the blades and the open section being opened forwardly in an operating direction of said squeegee, and a curved section for accumulating liquid which is defined such that an axial length thereof extends along an upper end portion of said blades and an inner circumferential wall surface of the curved section protrudes rearwardly in the operating direction, liquid being swept up by said blades and being transferred from the lower end portion of said blades to the upper end portion thereof, whereafter the liquid is then introduced into said section for accumulating liquid, the extreme end portions of the blades being bent towards the side of said open section of said baseplate section.

2. The squeegee as claimed in claim 1, wherein said section for accumulating liquid has side wall portions on opposite ends thereof, the side walls being substantially perpendicular to the upper end portion of said blades, said side wall portions further protruding forwardly in the operating direction.

3. The squeegee as claimed in claim 2, wherein one of said blades positioned rearwardly in the operating direction is longer than another of said blades positioned forwardly in the operating direction.

4. The squeegee as claimed in claim 2, wherein said section for accumulating liquid includes at least two pairs of relieved streaks, the two pairs of streaks extending along said inner circumferential wall surface and being inclined with respect to said surface to be cleaned such that a lower end of each of the relieved streaks is positioned in an outward direction, while the upper ends thereof are positioned toward a central direction of said baseplate section.

5. The squeegee as claimed in claim 1, wherein said section for accumulating liquid includes at least two pairs of relieved streaks, the two pairs of streaks extending along said inner circumferential wall surface and being inclined with respect to said surface to be cleaned such that a lower end of each of the relieved streaks is positioned in an outward direction, while the upper ends thereof are positioned toward a central direction of said baseplate section.

6. The squeegee as claimed in claim 1, wherein each of said blades has an extreme end portion, the extreme end portion of the blades abuts on said surface to be cleaned, the extreme end portions being bent towards the side of said open section of said baseplate section.

7. The squeegee as claimed in claim 1, wherein one of said blades positioned rearwardly in the operating direction is longer than another of said blades positioned forwardly in the operating direction.

8. The squeegee as claimed in claim 1, wherein each of the blades is bent at an acute angle such that the extreme end portion of each blade is bent toward the side of the open section of said baseplate section, the blades therefore being nonlinear from the lower end portion of said baseplate section to a tip of the blades.

9. The squeegee as claimed in claim 8, wherein each of the blades is bent at an angle of about 45°.

10. A squeegee comprising:

a baseplate section extending along a surface to be cleaned;

a plurality of blades, each of the blades being disposed on a lower end portion of said baseplate section and being formed with a profile projecting outwardly from said baseplate section, said baseplate section having an open section positioned on an upper end portion of said blades, the open section extending along the blades and the open section being opened forwardly in an operating direction of said squeegee;

a curved section for accumulating liquid which is defined such that an axial length thereof extends along an upper end portion of said blades and an inner circumferential wall surface of the curved section protrudes rearwardly in the operating direction, liquid being swept up by said blades and being transferred from the lower end portion of said blades to the upper end portion thereof, whereafter the liquid is then introduced into said section for accumulating liquid; and means for moving liquid toward a center of the curved section, the means for moving comprises at least one pair of streaks extending along the inner circumferential wall of the curved section, the pair of streaks being inclined to extend toward the center of the curved section, upper ends of the streaks being separated such that the upper ends of the streaks are out of contact with one another, liquid introduced into the section for accumulating liquid being moved toward the center of the curved section by the means for moving.

11. The squeegee as claimed in claim 9, wherein the means for moving comprises two pairs of relieved streaks, the two pairs of streaks extending along the inner circumferential wall surface and being inclined with respect to said surface to be cleaned such that a lower end of each of the relieved streaks is positioned in an outward direction while the upper ends thereof are positioned toward a central direction of said baseplate section.

12. The squeegee as claimed in claim 9, wherein the at least one pair of streaks of the means for moving have upper ends which are closer to the center of the curved section than the lower ends thereof.

13. A squeegee comprising:

a baseplate section extending along a surface to be cleaned;

a plurality of blades, each of the blades being disposed on a lower end portion of said baseplate section and being formed with a profile projecting outwardly from said baseplate section, said baseplate section having an open section positioned on an upper end portion of said blades, the open section extending along the blades and the open section being opened forwardly in an operating direction of said squeegee; and a curved section for accumulating liquid which is defined such that an axial length thereof extends along an upper end portion of said blades and an inner circumferential wall surface of the curved section protrudes rearwardly in the operating direction, liquid being swept up by said blades and being transferred from the lower end portion of said blades to the upper end portion thereof, whereafter the liquid is then introduced into said section for accumulating liquid;

each of the blades being bent at an acute angle such that the blades are nonlinear from the lower end portion of said baseplate section to a tip of the blades, the blades being bent such that an extreme end portion thereof is bent toward the side of the open section of said baseplate section.

14. The squeegee as claimed in claim 13, wherein each of the blades is bent at an angle of about 45°.

* * * * *